US007802399B2

(12) United States Patent
Shelton et al.

(10) Patent No.: US 7,802,399 B2
(45) Date of Patent: Sep. 28, 2010

(54) PLANT STAND

(76) Inventors: Nancy Shelton, 707 Jay Jay Cove, Kyle, TX (US) 78640-8812; Jerry Shelton, 707 Jay Jay Cove, Kyle, TX (US) 78640-8812

( * ) Notice: Subject to any disclaimer, the term of this patent is extended or adjusted under 35 U.S.C. 154(b) by 292 days.

(21) Appl. No.: 11/768,841

(22) Filed: Jun. 26, 2007

(65) Prior Publication Data

US 2007/0294940 A1 Dec. 27, 2007

Related U.S. Application Data

(60) Provisional application No. 60/805,790, filed on Jun. 26, 2006.

(51) Int. Cl.
*A47G 7/04* (2006.01)

(52) U.S. Cl. ..... 47/39; 47/47

(58) Field of Classification Search ..... 47/39, 47/70, 44, 45, 47, 904; 248/175; 211/85.23, 211/88.03; *A47G 7/00, 7/04*
See application file for complete search history.

(56) References Cited

U.S. PATENT DOCUMENTS

| | | | | | |
|---|---|---|---|---|---|
| 419,484 | A | | 1/1890 | Wayland | |
| 3,165,863 | A | * | 1/1965 | Duran | 47/47 |
| 3,471,968 | A | * | 10/1969 | Letz | 47/47 |
| 3,554,473 | A | * | 1/1971 | Rakov et al. | 248/519 |
| 4,173,098 | A | * | 11/1979 | Smith | 47/80 |
| D305,716 | S | * | 1/1990 | Ghafoorzai | D8/1 |
| 4,964,237 | A | * | 10/1990 | Specht | 47/41.01 |
| 4,965,876 | A | * | 10/1990 | Foldi et al. | 362/247 |
| 5,450,692 | A | | 9/1995 | Ruibal | |
| D363,652 | S | * | 10/1995 | Turner | D8/1 |
| 5,501,038 | A | * | 3/1996 | Gregoranto | 47/70 |
| 5,598,662 | A | | 2/1997 | Droste | |
| 6,209,258 | B1 | * | 4/2001 | Schneider | 47/46 |
| 6,895,713 | B2 | | 5/2005 | Warren | |
| 6,901,700 | B2 | * | 6/2005 | Trabka | 47/86 |
| 2007/0289210 | A1 | * | 12/2007 | Gray | 47/47 |
| 2008/0209806 | A1 | * | 9/2008 | Van Zijl | 47/70 |

FOREIGN PATENT DOCUMENTS

| | | | | |
|---|---|---|---|---|
| DE | 3312130 | A1 | * | 10/1984 |
| DE | 10213969 | C1 | * | 5/2003 |
| FR | 2558682 | A1 | * | 8/1985 |
| FR | 2791542 | A1 | * | 10/2000 |
| GB | 2098043 | A | * | 11/1982 |

* cited by examiner

*Primary Examiner*—Son T Nguyen
*Assistant Examiner*—Shadi Baniani
(74) *Attorney, Agent, or Firm*—Pehr Jansson; The Jansson Firm

(57) ABSTRACT

A plant stand with a circular base, locking arms and a main shaft. The plant stand can reside in a plant pot, with the circular base and locking arms fitting precisely with the bottom and sides of the plant pot. Additional plant pots may be placed upon the main shaft of the plant stand in a visually appealing fashion. Other systems and methods are disclosed.

12 Claims, 5 Drawing Sheets

PLANT STAND

CROSS-REFERENCE TO RELATED APPLICATIONS

This application is a non-provisional application claiming priority from provisional application Ser. No. 60/805,790 filed on Jun. 26, 2006, entitled Incredible Plant Stand That Invisibly Displays Terra Cotta Pots Vertically the teachings of which are incorporated by reference herein as if reproduced in full below.

BACKGROUND OF THE INVENTION

The present invention relates to potted plant holders, and more specifically to a potted plant stand that displays multiple terra cotta pots in a vertical formation.

Potted plant stands known in the art such as U.S. Pat. No. 6,895,713 to Warren may be held erect by burying the lower end of the stand in a plant pot. The Warren plant stand uses a planar base member resting face-to-face with the bottom of the plant pot, and two or more vertical fins buried below the top edge of the plant pot to hold the plant stand erect. The Warren patent also shows various methods of displaying plant pots on a plant stand. In particular, FIG. 5*b* shows plant pots stacked on a single rod in a plant stand contained in a lower pot. The entire disclosure of U.S. Pat. No. 6,895,713 to Warren is hereby incorporated by reference.

From the foregoing it will be apparent that there is a need for an improved method to provide a mechanism to hold a potted plant stand erect by burying the lower end in a plant pot without obstructing the drain hole and without inhibiting plant root growth. Also, there is a need to hold the plant pots on a single rod in a fixed orientation so that the pots can not rotate about the rod. Furthermore, there is a need for a potted plant stand that has improved protection from rusting. Finally, there is a need for a potted plant stand that can be stored without using too much space.

DETAILED DESCRIPTION OF THE INVENTION

Figure 1:
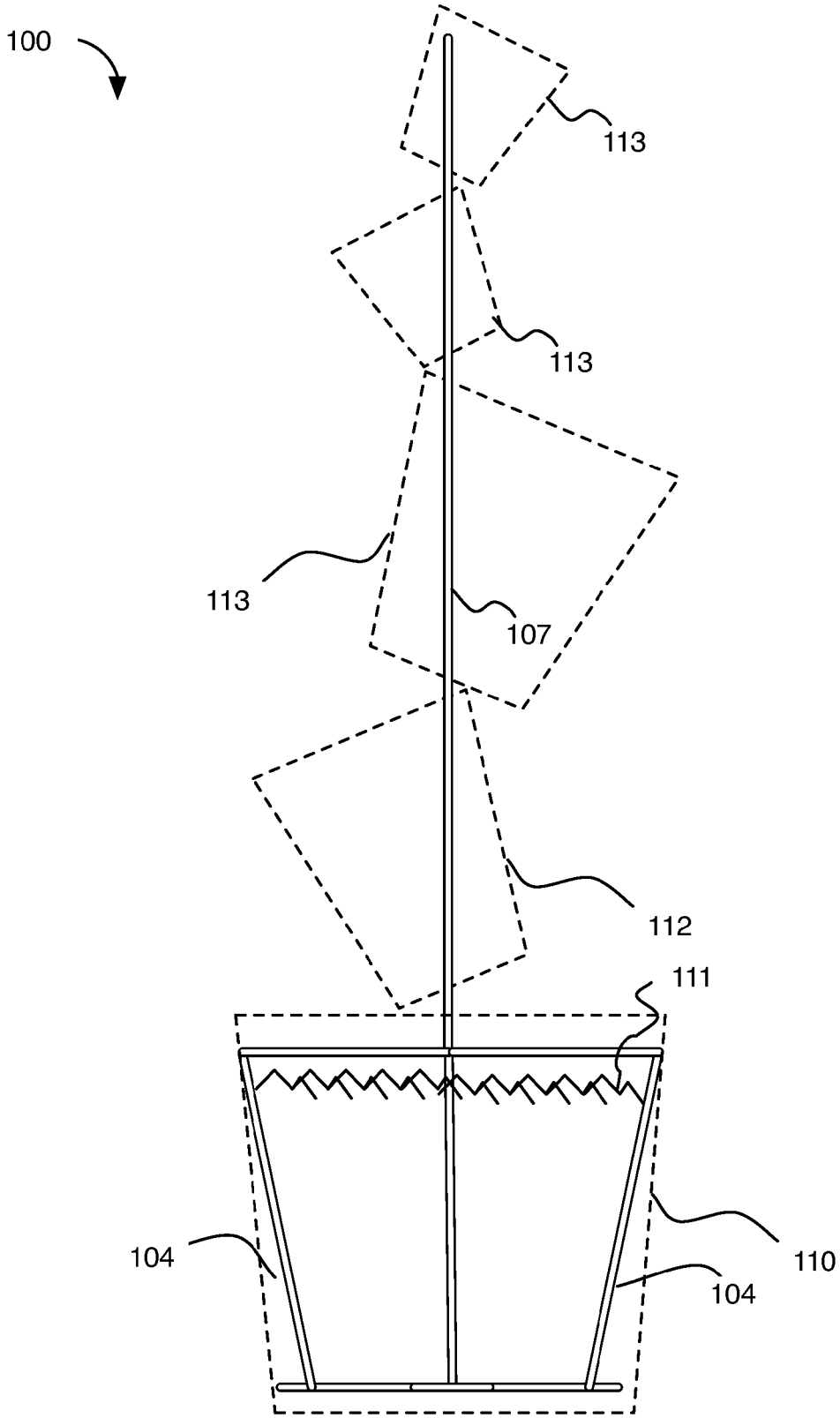
FIG. 1 is a drawing illustrating a possible use of the plant stand.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

Referring to the drawings, FIGS. 1-5 depict one potential use and various embodiments of the plant stand of the current invention. In particular, FIG. 1 shows the plant stand, depicted generally as 100, residing in a support plant pot 110. The lower portion of the plant stand 100 fits precisely with the bottom and sides of the support plant pot 110, and is covered with potting soil 111. A base plant pot 112 may be placed upon the main shaft 107 of the plant stand 100 at an appealing angle, and held in place between the locking arms. Additional decorative plant pots 113 can be placed upon the main shaft 107 in a decorative and visually appealing fashion without fear of the entire arrangement falling.

Figure 2:
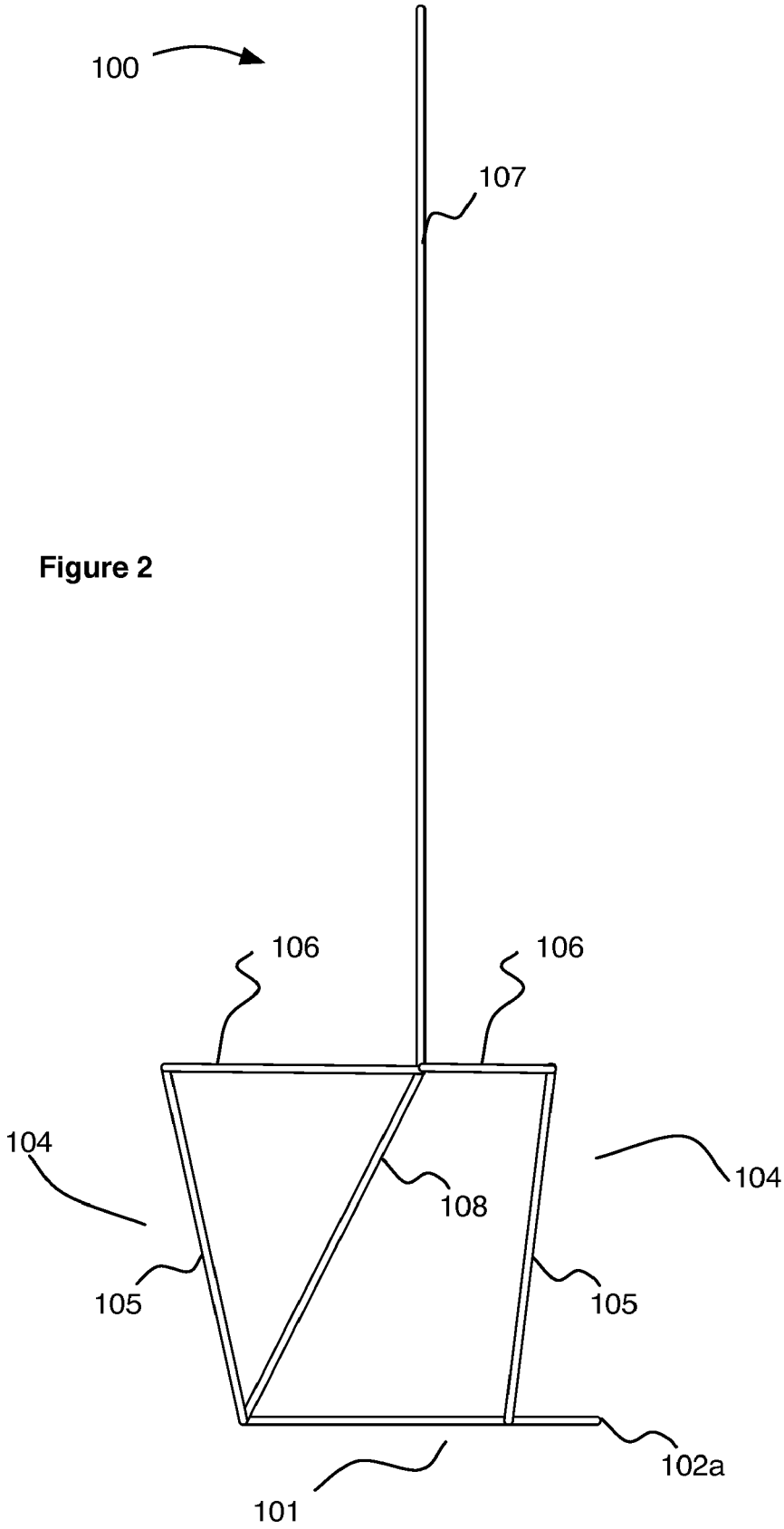
FIG. 2 is a drawing illustrating a side view of an embodiment of the plant stand.
Figure 3:
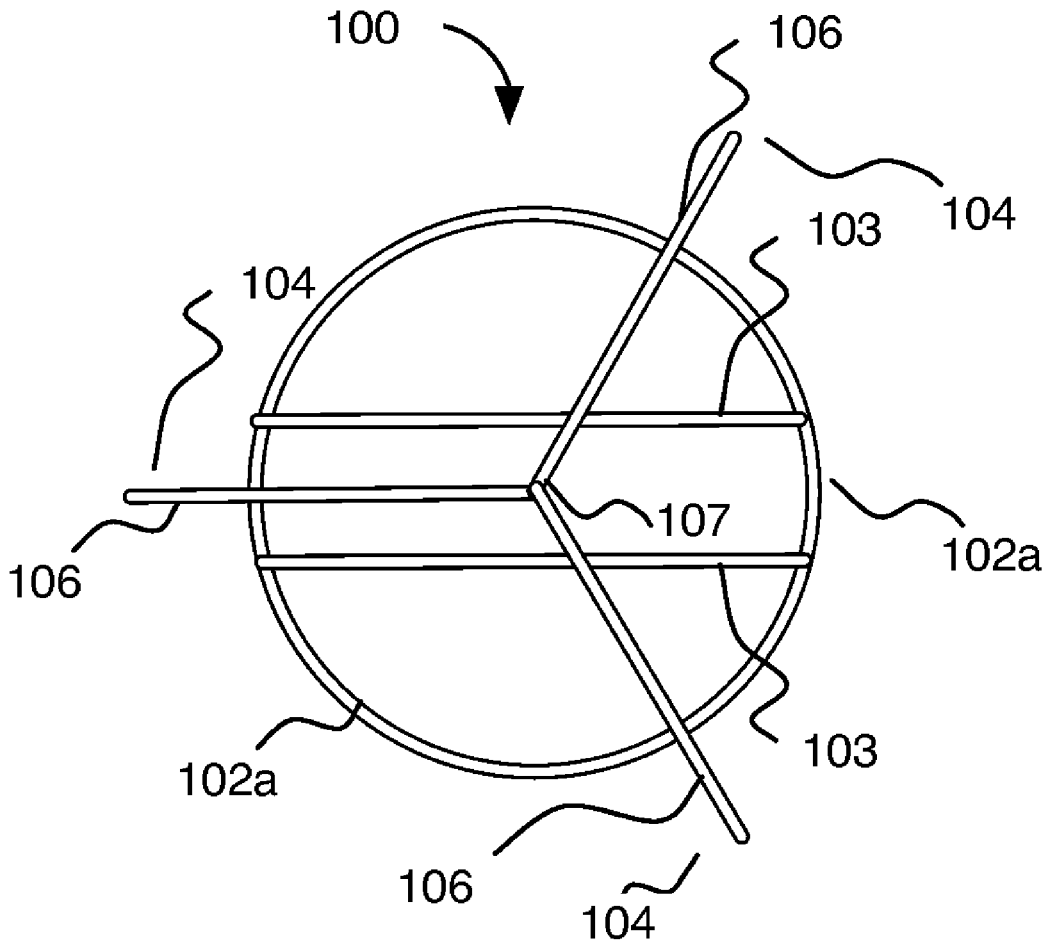
FIG. 3 is a drawing illustrating a bird's eye view of the embodiment shown in FIG. 2.

In one embodiment of the invention, a plant stand 100 is represented in FIGS. 2 and 3. The entire apparatus is constructed of rigid metal wire of sufficient thickness to provide support for the desired base plant pot 112 and decorative plant pot 113 sizes. In one embodiment of the invention, the rigid metal wire is 0.25-inch diameter wire. The base 101 consists of a circular ring 102*a* and one or more cord segments 103 attached at various points around the circular ring to provide rigidity and support for the plant stand 100. The radius of the circular ring 102*a* is chosen to precisely fit the bottom of the desired support plant pot 110 size. Because the entire apparatus is constructed of rigid metal wire, which typically has a circular cross section, even a single cord segment 103 passing through the middle of the circular ring 102*a*, will not obstruct the drain hole of the support plant pot 110.

One embodiment includes three locking arms 104 each consisting of an upright segment 105 and a horizontal segment 106. The locking arms 104 are formed into the two segments, for example, by bending the rigid metal wire to the desired angle. The locking arms 104 attach to the base 101 and extend upward and outward at an angle defined by the angle between the bottom and the wall of the desired support plant pot 110. In this way, the upright segment 105 of the locking arms 104 maintain contact with the support plant pot 110 and provide rigidity to the overall plant stand 100, without inhibiting root growth of plants in the support plant pot 110. The horizontal segments 106 of the three locking arms 104 are joined together at a point above the center of the circular ring 102*a*. In one embodiment, the main shaft 107 attaches to the same point above the center of the circular ring 102*a* as the locking arms 104. Placement of the base plant pot 112 on the main shaft 107 and cradled between two of the locking arms 104 prevents the base plant pot 112 and any decorative plant pots 113 from rotating around the main shaft 107.

Figure 4:
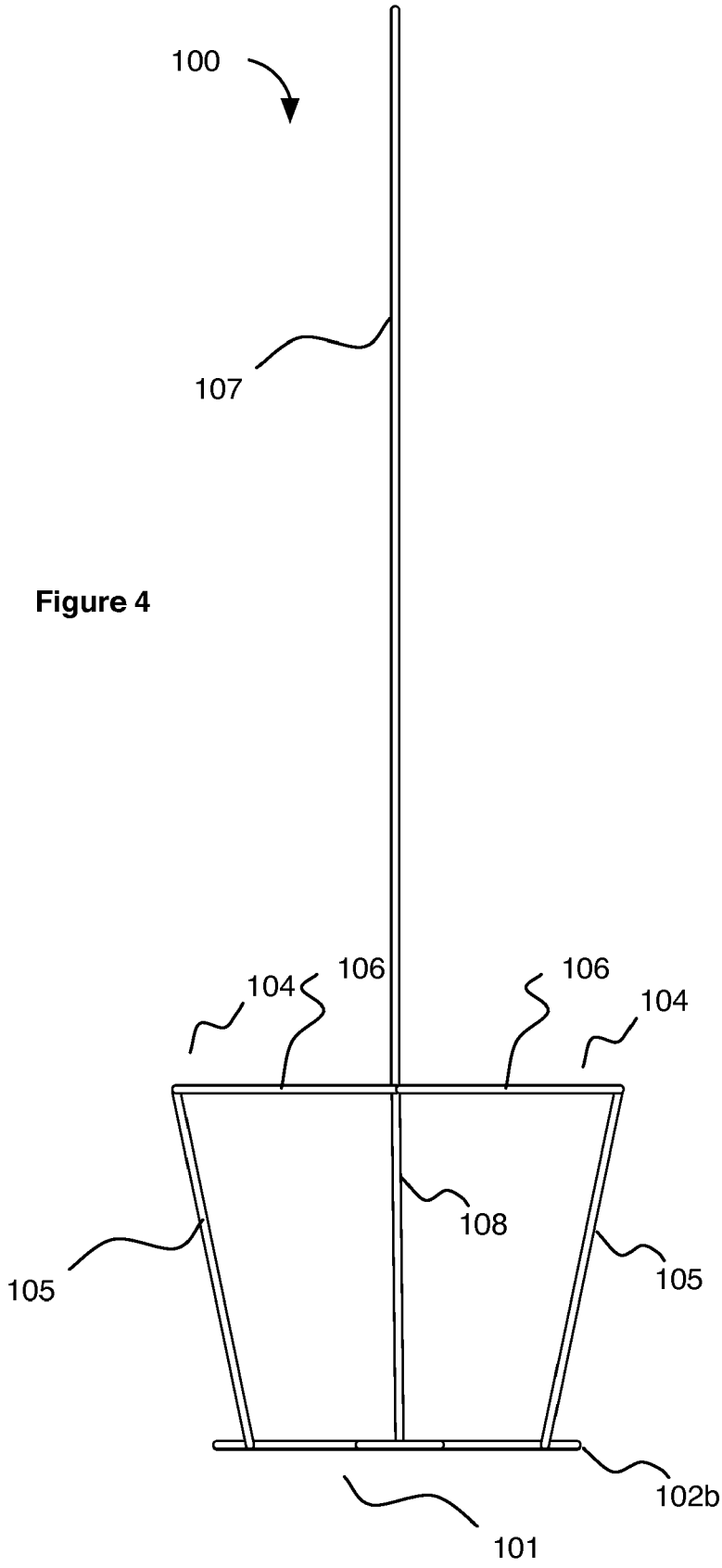
FIG. 4 is a drawing illustrating a side view of a different embodiment of the plant stand.
Figure 5:
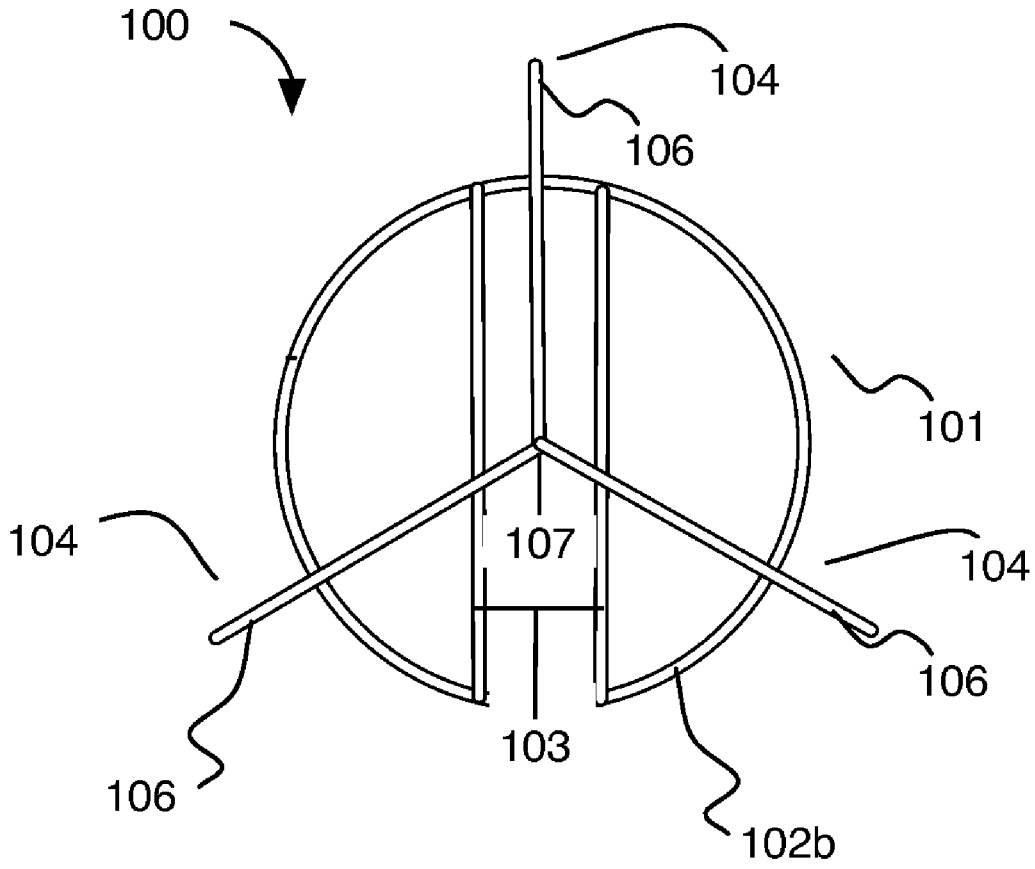
FIG. 5 is a drawing illustrating a bird's eye view of the embodiment shown in FIG. 4.

In an alternate embodiment of the current invention, shown in FIGS. 4 and 5, the base 101 consists of a circular arc segment 102*b* and two cord segments 103. Each cord segment 103 attaches at one end to the end of the circular arc segment 102*b*. The two cord segments 103 are parallel to each other and attach at their other ends to the circular arc segment 102*b*. The radius of the circular arc segment 102*b* is chosen to precisely fit the bottom of the desired support plant pot 110 size. This embodiment permits stacking of plant stands 100 when not in use without taking excessive space.

In another embodiment of the current invention, to improve the rigidity and load bearing ability of the plant stand 100, the plant stand 100 includes a support bar 108 between the base 101 and the horizontal segment 106 of one of the locking arms 104.

In another embodiment of the current invention, the rust inhibiting properties of the plant stand 100 are improved through application of a powder coat finish.

Although specific embodiments of the invention have been described and illustrated, the invention is not to be limited to the specific forms or arrangements of parts so described and illustrated. The invention is limited only by the claims.

We claim:

1. A plant stand comprising:

a base having a circular metal wire ring and at least one chord segment;

where the circular ring has a center and where the radius of the circular ring is sized to fit in the bottom of a garden pot and sized to precisely fit the garden pot, and;

where each chord segment connects two points on the circular wire ring;

a plurality of locking arms, each having an upright segment and a horizontal segment;

where the upright segment of each locking arm extends upward from the circular ring and is angled radially outward at an angle to conform to an inner wall of the garden pot; and where the horizontal segment extends radially inward and joins together with all of the other locking arms at a point above the center of the circular wire ring, and;

a main shaft, joined with the horizontal segments of the locking arms above the center of the circular ring and extending vertically above the point where the locking arms are joined together, and; a support bar affixed between said base and the horizontal segment of one of said locking arms.

2. The Plant Stand as described in claim 1, wherein the plurality of locking arms comprises three locking arms.

3. The Plant Stand as described in claim 2, wherein the three locking arms are arranged around the circular ring 120 degree apart.

4. The Plant Stand as described in claim 1 further comprising a support bar affixed between said base and the horizontal segment of one of said locking arms.

5. The Plant Stand as described in claim 4, wherein the base, the locking arms, the main shaft and the support rod are constructed from metal wire.

6. The Plant Stand as described in claim 5 wherein said metal wire has a powder coat finish.

7. The Plant Stand as described in claim 1, wherein the locking arms and the main shaft are constructed from metal wire.

8. The Plant Stand as described in claim 7 wherein said metal wire has a powder coat finish.

9. The plant stand of claim 1 wherein the circular wire ring has a diameter of 0.25 inches.

10. The plant stand of claim 1 wherein the garden pot has a bottom and the circular wire ring has a radius selected such that the wire ring fits precisely against the bottom of the garden pot.

11. The Plant Stand as described in claim 1, wherein the locking arms and the main shaft are constructed from metal wire.

12. The Plant Stand as described in claim 1, wherein the base, the locking arms, the main shaft and the support rod are constructed from metal wire.

* * * * *